United States Patent [19]

Breedveld

[11] 3,977,388

[45] Aug. 31, 1976

[54] HEATING APPARATUS

[75] Inventor: Jacobus Christiaan Breedveld, Dinxperlo, Netherlands

[73] Assignee: N. V. Vulcaansoord IJzergieterij en Emailleerfabrieken, Terborg, Netherlands

[22] Filed: Nov. 15, 1974

[21] Appl. No.: 524,155

[30] Foreign Application Priority Data

Dec. 14, 1973 Netherlands ..... 7317145

[52] U.S. Cl. ..... 126/110 R; 126/116 R; 165/154

[51] Int. Cl.[2] ..... F24H 3/10

[58] Field of Search ..... 126/110 R, 110 B, 116 R; 165/154, 164

[56] References Cited

UNITED STATES PATENTS

| | | | |
|---|---|---|---|
| 1,875,752 | 9/1932 | Montero | 126/110 B |
| 2,499,067 | 2/1950 | Jenson | 126/110 B |
| 2,678,811 | 5/1954 | Mueller | 126/110 B X |
| 3,841,301 | 10/1974 | Chamberlain | 126/110 R |

*Primary Examiner*—William E. Wayner
*Assistant Examiner*—William E. Tapolcai, Jr.
*Attorney, Agent, or Firm*—Geo. Fred Smyth

[57] ABSTRACT

A heating apparatus with a combustion chamber defined by walls which are in heat-exchange relationship with the ambient air, in which a part of these walls define a channel communicating with a blower, this in such a manner that ambient air is sucked in through this channel from near the upper side of the apparatus, and warm air is blown out substantially horizontally near the bottom side of the apparatus.

4 Claims, 3 Drawing Figures

FIG. 1
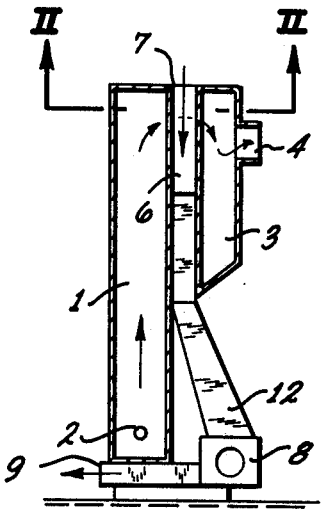
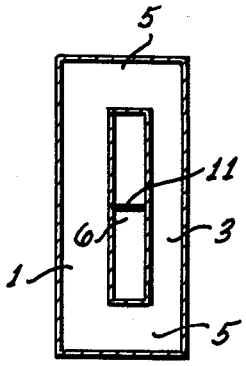
FIG. 2
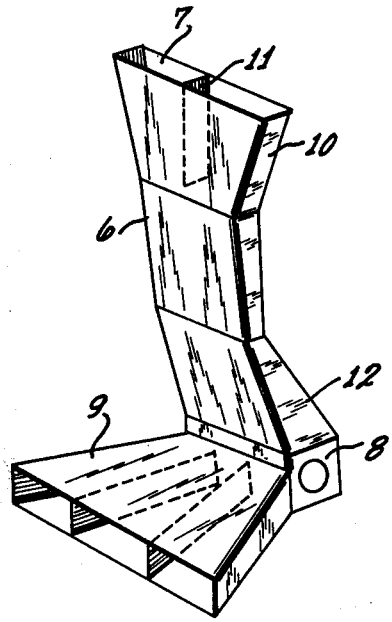
FIG. 3

HEATING APPARATUS

The invention relates to a heating apparatus having a combustion chamber and a discharge chamber or discharge connection communicating with a discharge duct for combustion gases, at least a part of the wall of this apparatus serving as heat exchanger surfaces contacting the ambient air.

In the known apparatuses of this kind the air contacting said surfaces is heated so that its density is reduced, and this air will rise and is replaced by cold air flowing along the floor of the space to be heated.

This manner of heating has many disadvantages. In the first place hot air will accumulate near the upper wall of the space to be heated, where, after all, the heating demand is smallest, whereas the colder air which will partly flow inwards from the outside through door gaps will strike along the feet of persons present in this space, which will reduce the comfort so that there is very often a tendency to raise the heating temperature so as to raise the bottom temperature accordingly, which will lead to an accordingly higher fuel consumption. Moreover the higher temperature near the upper wall will lead, there, to a higher heat leakage since the latter is a function of the temperature difference in respect of the adjacent space. In view of the rather large temperature differences between the lower and upper parts of the space, it is often difficult to obtain a stable temperature control adapted to the desired average temperature by means of a thermostat included in the heating apparatus.

The object of the invention is to provide a heating apparatus of this kind which does not have the above-mentioned drawbacks. To that end the apparatus according to the invention is characterised in that at least a part of the heat exchange walls define a channel communicating at both extremities with the ambient air, in which channel a blower is included, the outflow end of this assembly opening in such a manner below the bottom of the apparatus that the air blown out which is heated by heat exchange in this passage is blown off substantially horizontally along the floor of the space to be heated. Preferably this channel is, at the outflow end, made divergent in such a manner that the outflow velocity of the air does not exceed a desired limit value, and the heat exchange part proper can be shaped, and particularly can be constricted, in such a manner that the flow velocity obtains, there, a value which is favourable for the heat exchange, and in particular turbulences will occur which enhance the heat exchange. Moreover additional auxiliary partitions may be used for promoting the occurrence of such turbulences.

In this manner an air flow in the space to be heated will be obtained which is opposite to the flow which occurs in the vicinity of the usual heating apparatuses, and the hot air accumulated in the upper part of this space, which needs less heating for being brought to the desired temperature, will be sucked away. In particular the intake end of the heat exchange channel opens in the upper wall of the apparatus so as to obtain an air flow which is oppositely directed to the flow of combustion gases in the adjacent combustion chamber.

In this manner not only a hot air flow flowing along the floor is obtained, but, moreover, the temperature difference between the lower and upper parts of the space to be heated is reduced so that less heat leakage will occur and, moreover, a more uniform temperature distribution is obtained which can be maintained with less heat supply from the heating apparatus. A further advantage is that more heat can be transferred from the combustion gases to the air.

It is remarked that blowers for bringing about a hot air flow along the floor are known per se, but these blowers take in air from the vicinity of the heating apparatus without considerably disturbing the mainly upward flow of hot air in that region, so that the further advantages of the apparatus according to the invention cannot be obtained thereby.

In order to avoid that, on reaching the desired temperature and after switching off the burner situated in the combustion chamber, hot air will be taken away from the inner space of the apparatus because of the draught in the flue, so that heat accumulated in the walls of the apparatus would, then, flow off through the flue, and often also hot air would be taken away from the space to be heated, the blower is, in particular, controlled by means of at least one heat sensor which is positioned in such a manner that the temperature of the wall of the apparatus or of the air flowing off from the channel can be determined thereby, this control being effected in such a manner that the heat of the wall is at least partially transferred to the air of the space to be heated so as to avoid loss of heat. Moreover an air flow through the heat exchange channel adapted to the heat supply from the combustion can be obtained by controlling, by means of at least one additional heat sensor, the blower speed in such a manner that at a higher heat supply this speed is increased.

The invention will be elucidated below by reference to a drawing, showing in:

FIG. 1 a simplified schematic cross-section through a heating apparatus according to the invention;

FIG. 2 a cross-section on line II—II of FIG. 1; and

FIG. 3 a representation in perspective of the heat exchange channel of this apparatus.

The heating apparatus shown in FIG. 1 comprises a combustion chamber 1 in which a burner 2, e.g. a gas burner, is arranged. At the lower side of this chamber secondary combustion air can flow in, viz. in an apparatus with a flue connection from the space to be heated, and in a so-called wall stove from a supply duct passing through a wall.

The hot combustion gases rise in the chamber 1, and flow off towards a discharge chamber or draught interrupter 3 in which a discharge tube 4 opens which is to be connected to a flue or a discharge tube passing through the wall.

As appears from FIG. 2 the chambers 1 and 3 are interconnected at the lateral sides by means of passages 5. Between these passages a channel 6 is situated which is defined by the facing walls of the chambers 1 and 3 and of the passages 5.

This channel 6 has, at the upper side, an inlet opening 7, and communicates at the lower side with the intake side of the blower 8. The outflow side of this blower is connected to a blowing nozzle 9 which is directed substantially horizontally. This nozzle is made divergent in such a manner that the outflow velocity of the air is reduced sufficiently for not yet being experienced as disagreeable at the lowest air temperature. Moreover such a channel provides a wide outflow distribution of the air.

Furthermore the channel 6 is, as shown at 10, gradually converging from the inlet opening 7 so as to bring the air velocity at a value which is favourable for the heat exchange with the adjacent walls, and, at the same time, to generate therein air turbulences enhancing the heat transfer. The occurrence of turbulences can, furthermore, be promoted by arranging partitions 11 which increase the wall surface and, thus, the wall friction, and turbulences will then be generated by velocity differences. Of course also other means which are favourable for the occurrence of turbulences can be used.

The part 10 joins an adapting piece 12 forming a transition between the narrower channel part and the intake opening of the blower 8. In the case shown this adapting piece itself is not contacting the chamber 1, but it is, in some cases, possible to make at least a part of the wall of the adapting piece contiguous with the chamber 1. The shape of this adapting piece depends, of course, on the dimensions and position of the blower and of the heat exchange channel proper.

The whole heat exchange assembly is shown in FIG. 3 as a unitary structure. Although it is possible to manufacture such a unit as such and to arrange it in a passage of the heating apparatus, it is generally preferred to constitute at least the part 10 by walls of the chambers 1 and 3.

The blower is driven by an electric motor which is preferably provided with a speed regulation controlled by heat sensors. These heat sensors are positioned in or near the wall part of the heating apparatus. The blower motor is only switched off as soon as the temperature of the wall or of the air flowing through has fallen below a given value, so as to transfer as much heat accumulated in this wall as possible to the air used for heating, and to prevent thereby that this heat flows off by internal convection towards the discharge duct. Below a given wall temperature an inverse heat transfer will take place of course, so that the blower should have been switched off in time before reaching this temperature. If, on the contrary, the wall temperature sharply rises, it can be advisable to increase the air flow rate in order to improve the removal of heat, which can be effected by means of one or more additional heat sensors.

The shape of the heat exchange channel is shown in the drawing only by way of example. It will be clear that this shape can be modified in many ways, and is, in the first place, determined by the requirements for obtaining an optimal heat transfer. Instead of or in addition to the channel shown between the chambers 1 and 3, also a double outer wall can be used in which case the heat transfer will be completely effected by the air circulated by the blower. It is also possible to arrange heat transfer tubes in the chambers 1 and/or 3 by means of which the heat exchange surface can be increased, but of course also vanes or the like can be provided on the heat exchange surfaces for that purpose.

In this manner a heating device is obtained which will take in air from the upper part of the space to be heated to blow it out again along the floor after being heated, so that an air flow is obtained which is substantially oppositely directed to the natural flow occurring with the usual apparatuses. Since, moreover, the air flow in the heat exchanger is, as shown, oppositely directed to the combustion gas flow in the combustion chamber, heat transfer will take place in counter-current, this in contradistinction to the transfer in the case of a natural air flow, so that a better transfer effect is obtained and less air will flow off unused through the discharge.

Of course cooling of the combustion gases should be restricted to such an extent that the heating required for sustaining the draught and for preventing condensation is maintained.

It has appeared that with a heating apparatus of this kind the temperature difference between the upper and lower parts of a space to be heated can be considerably reduced compared with the known apparatuses, so that not only a more agreeable temperature distribution, but also a better utilisation of the fuel will be obtained. Together with a better heat transfer in the apparatus itself, this will lead to fuel savings of at least 15 %.

Furthermore it will be clear that in summer the blower of such an apparatus can also be used for circulating the air in the adjacent room, in which case, of course, the said heat sensors have generally to be switched over or off.

Within the scope of the invention many modifications are possible.

I claim:

1. In a heating apparatus including a combustion chamber with a gas burner arranged in its lower part, a juxtaposed, spaced discharge chamber connected to a combustion chamber discharge duct, and a connecting duct interconnecting the upper parts of said chambers, wherein at least a portion of the walls of said chambers serve as heat exchange surfaces contacting ambient air to be heated, the improvement comprising:

vertical ambient air channel means positioned between at least a portion of said chambers, said channel means being defined by the spaced walls of said chambers and including an upper air intake end and a lower air discharge end, blower means in communication with the lower end of said channel means, and said air discharge end of said blower means being structured at the base of said apparatus below the combustion chamber such that ambient air heated by flow through said channel in contact with the walls of said chambers is discharged substantially horizontally along the floor of the space to be heated.

2. In a heating apparatus as set forth in claim 1 wherein the air discharge end of said blower means is a diverging, substantially horizontal channel for maintaining the velocity of heated air discharged at the discharge end below a desired limit value.

3. In a heating apparatus as set forth in claim 1 wherein said connecting duct includes lateral passages extending at both sides of the channel means, and said channel means including wall portions in heat exchanging relation with said lateral passages.

4. In a heating apparatus as set forth in claim 1 wherein said channel means is surrounded, at least in part in a vertical direction by walls which form the combustion chamber and the discharge chamber.

* * * * *